United States Patent [19]

Adler et al.

[11] 4,380,262

[45] Apr. 19, 1983

[54] APPARATUS FOR DOUBLE ROLLER CHILL CASTING OF CONTINUOUS METAL FOIL

[75] Inventors: Ralph P. I. Adler, Wellesley; Thomas J. Gorsuch, Westwood; Yellapu V. Murty, Acton; Alexander R. Woronicki, Stoneham, all of Mass.

[73] Assignee: GTE Laboratories Incorporated, Waltham, Mass.

[21] Appl. No.: 200,861

[22] Filed: Oct. 27, 1980

[51] Int. Cl.[3] ..... B22D 11/00; B22D 11/06; B22D 11/124

[52] U.S. Cl. ..... 164/423

[58] Field of Search ..... 164/462, 463, 428, 423, 164/441, 442, 447, 448, 443

[56] References Cited

U.S. PATENT DOCUMENTS

| | | | |
|---|---|---|---|
| 3,559,719 | 2/1971 | Rossi | 164/273 |
| 3,856,074 | 12/1974 | Kavesh | 164/87 |
| 3,862,658 | 1/1975 | Bedell | 164/87 |
| 3,881,541 | 5/1975 | Bedell | 164/87 |
| 4,049,042 | 9/1977 | Maringer | 164/278 |
| 4,142,571 | 3/1979 | Narasimhan | 164/88 |
| 4,202,404 | 5/1980 | Carlson | 164/423 |
| 4,212,343 | 7/1980 | Narasimhan | 164/64 |
| 4,212,344 | 7/1980 | Uedaira et al. | 164/87 |
| 4,223,719 | 9/1980 | Riederer et al. | 164/448 |
| 4,224,978 | 9/1980 | Klein | 164/86 |

FOREIGN PATENT DOCUMENTS

| | | | |
|---|---|---|---|
| 523580 | 4/1979 | Canada . | |
| 54-23030 | 2/1979 | Japan | 164/423 |
| 54-48637 | 4/1979 | Japan . | |

OTHER PUBLICATIONS

Chen, H. S. and Miller, C. E., "A Rapid Quenching Technique for the Preparation of Thin Uniform Films of Amorphous Solids", *The Review of Science Instruments*, vol. 41, pp. 1237–1238, (1970).

K. Ohmori, K. Arai and N. Tsuya, "Ribbon-Form Sendust Alloy Made by Rapid Quenching Methods", *Applied Physics*, vol. 21, pp. 335–338, (1980).

E. Babic, E. Girt, R. Krsnik, B. Leontic, "Production of Large Samples of Ultrarapidly Quenched Alloys of Aluminum by Means of a Rotating Mill Device", *Journal of Physics*, vol. 3, (1970).

*Primary Examiner*—Gus T. Hampilos
*Assistant Examiner*—Jerold L. Johnson
*Attorney, Agent, or Firm*—Jerry F. Janssen

[57] ABSTRACT

An apparatus useful for the production of wide amorphous or polycrystalline metal foils of substantially uniform thickness by the double roller chill quenching method comprises a fixed roller member and a spring-loaded movable roller member mounted on a set of mounting rails. The movable roller member is maintained at a selectably adjustable minimum spacing from the fixed roller member and is free to move away from this position of minimum spacing to accommodate forces tending to displace the rollers from one another. A spring urges the movable roller toward the fixed roller and provides for selectable adjustment of the restoring force urging the rollers together.

6 Claims, 4 Drawing Figures

APPARATUS FOR DOUBLE ROLLER CHILL CASTING OF CONTINUOUS METAL FOIL

BACKGROUND OF THE INVENTION

This invention relates to apparatus employed in melt spinning of metals and metallic alloys to produce polycrystalline or amorphous foil. More particularly, it is concerned with an apparatus useful in the production of wide continuous foil by the double roller chill quenching method.

Melt spinning of metals is a process whereby a free jet of molten metal is impinged upon a rapidly moving cooled surface to chill quench the molten material to produce continuous foil. Melt spinning of metallic alloys provides the advantage that the rapid temperature quenching of the molten material, often on the order of $10^3$ to $10^6$ deg C. $sec^{-1}$, permits the production of solid solutions of two or more metals which are mutually insoluble in the solid state and would otherwise separate upon slow cooling.

Numerous methods have been proposed for the melt spinning of metallic alloys including the double roller technique described by H. S. Chen et al. in *Rev. Sci. Instrum.*, 41:1237 (1970) and by E. Babic et al. in *J. Phys. (Section E) Sci. Instrum.*, 3:1014 (1970). In general, their apparatus comprised two rollers arranged with their axes parallel and driven to contrarotate at about 100–5000 rpm. Molten metal was delivered to the gap between the rollers where it was quenched by contact with the cool roller surfaces to produce thin foil.

However, in following the twin roller quenching technique, it is necessary that the metal be completely quenched to the solid state before it reaches the point of minimum gap spacing between the rollers since there is no contact between the metal and the roller surfaces after this point to provide further conductive cooling. Puddling of excess molten metal on the rollers, coupled with complete quenching of the metal to the solid state before it reaches the point of minimum spacing between the rollers results in the production of foil which is thicker than the roller gap spacing. This phenomenon causes serious problems in double roller apparatus where the roller positions are fixed, and virtually eliminates the possibility of producing continuous metal foil, that is, foil strips of lengths greater than a few meters.

In those instances where the high temperature fracture toughness of the resulting foil is less than the pressure exerted by fixed rollers, when excess metal is forced between the rollers, the foil will have cracks and slippage plane deformations which render it unusable for most applications. Moreover, the bumping and bouncing of the rollers which results in such situations causes the foil to have non-uniform thickness and width.

On the other hand, if the high temperature fracture toughness of the foil is greater than the pressure exerted by the fixed rollers, when excess metal is forced between the rollers, it scores or otherwise damages the surfaces of the rollers. This becomes a particular problem when the rollers are faced with copper or other soft metal, chosen because of its superior heat conductive property.

One apparatus designed with a view to overcoming the problems discussed above is disclosed in U.S. Pat. No. 3,881,541. In the apparatus disclosed therein, the rollers are narrow and are coextensive with the desired width of the foil filament, about 0.003 inch to 0.100 inch. Excess molten metal delivered to the roller gap displaces laterally along the roller faces where it is removed at the roller edges as unwanted flash by means of an air knife. The resulting foil is of a thickness equal to the fixed roller gap spacing and width equal to the roller face width.

SUMMARY OF THE INVENTION

The apparatus of the present invention overcomes the disadvantages inherent in fixed double roller chill quenching apparatus while permitting the production of wide continuous foil of substantially uniform thickness and width.

An apparatus for double roller chill casting of continuous metal foil in accordance with the present invention comprises first and second rotary chill roller members, a means for delivering a stream of molten metal between the roller members, a mounting means for movably mounting the first roller member with respect to the second roller member, a restoring means for urging the first movable roller member toward the second roller member, a positioning means for maintaining the first roller member spaced apart from the second roller member by a minimum spacing, and a means for synchronously contrarotating the chill roller members, whereby when molten metal is delivered between the contrarotating roller members and material between the rollers exerts a displacing force to move the first movable roller member away from its position of minimum spacing from the second roller member, the restoring means exerts a restoring force to urge the first roller toward the second roller and to balance the displacing force thereby establishing a dynamic steady state spacing between the roller members greater than the minimum spacing to produce continuous metal foil of substantially uniform thickness equal to the dynamic steady state spacing.

DESCRIPTION OF THE PREFERRED EMBODIMENTS

Figure 1:
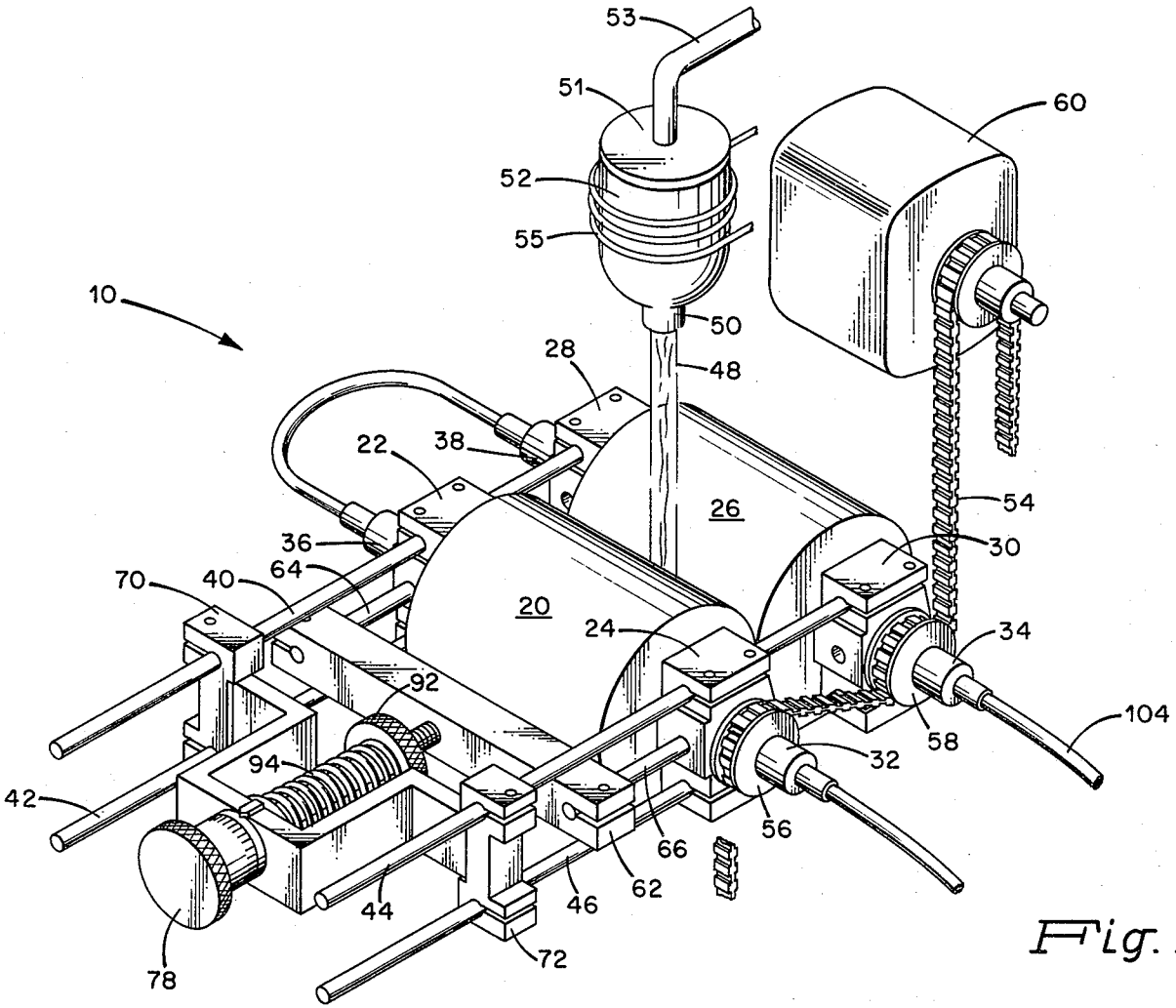
FIG. 1 is a perspective view of a double roller chill casting apparatus in accordance with one embodiment of the invention.

Referring to the drawing figures, one embodiment of the apparatus in accordance with the present invention is depicted in FIG. 1. The apparatus 10 comprises twin rollers 20 and 26 of equal diameter. The first chill roller member 20 is rotatably mounted on bearing members 22 and 24. A second chill roller member 26 is similarly rotatably mounted on bearing members 28 and 30. In a preferred embodiment of the invention, the chill roller members 20 and 26 are hollow and are internally cooled by means of a coolant such as water circulated through rotary seals 32, 34, 36 and 38 and flexible tubing 104 attached to the hollow shafts of each roller member.

The roller members are faced with a material of high thermal conductivity, preferrably copper, brass, beryllium copper or the like.

The bearing members 22 and 24 of the first roller member 20 are slideably mounted on mounting rails 40, 42, 44 and 46 to permit roller member 20 to move toward or away from roller member 26. The bearing members 28 and 30 of the second roller member 26 are preferably fixedly mounted on mounting rails 40, 42, 44, and 46. The mounting rails are shown in FIG. 1 as a set of parallel rods, but in alternative embodiments may take the form of solid rails, channels or the like which permit slideable motion of the bearing members 22 and 24 of the first roller member 20.

The metal to be cast into thin foil is melted in a crucible 52 which is heated by a resistance or induction furnace (not shown) and is delivered as a molten stream 48 to the gap between the parallel roller members 20 and 26. As shown in FIG. 1, the molten metal is delivered as a stream 48 from a single circular orifice 50 in the base of crucible 52, but alternative embodiments permit the delivery of the molten metal from a linear array of circular orifices, an elliptical orifice, or a slotted orifice in the base of the crucible to permit the production of wide foils.

In a preferred embodiment of the invention, the crucible 52 is capped with a cover 51. A tube 53 passing through the cover 51 permits pressurizing the molten metal with an inert gas such as argon to force the metal from the crucible 52 as a jet 48. The velocity of the jet 48 of molten metal delivered to the gap between the roller members is controlled by the magnitude of the inert gas overpressure applied to the melt contained in crucible 52 during the casting of foil.

The roller members 20 and 26 in accordance with the present invention are sufficiently wide enough to contain all of the molten metal delivered to the roller gap during the casting of foil so that the foil that is produced is narrower than the roller members. The apparatus is thus capable of producing wide continuous foil while eliminating the problems associated with bumping or bouncing of the roller members.

During the chill casting of foil, roller members 20 and 26 are synchronously contrarotated by a variable speed DC motor 60 and a notched belt 54 running over gear pulleys 56 and 58. The belt is shown cut away in FIG. 1, but in a preferred embodiment of the invention, the belt is continuous and runs over an idler pulley which is lightly spring loaded to allow for relative movement of the first roller member 20 with respect to the second roller member 26.

Figure 2:
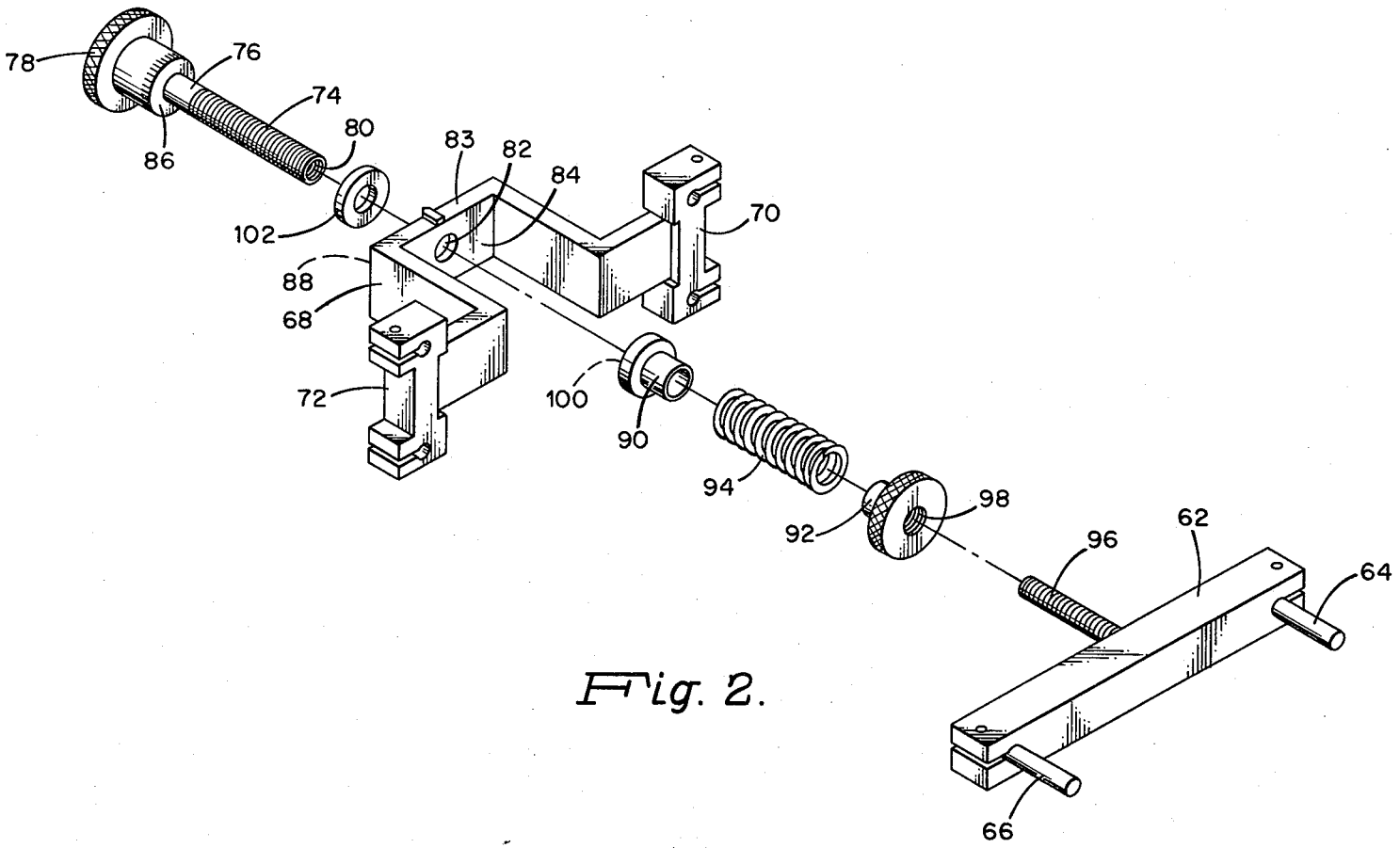
FIG. 2 is an exploded perspective view of a portion of the double roller chill casting apparatus of FIG. 1.

In the embodiment of the invention shown in FIG. 1, the first movable roller member 20 is both positioned and urged toward the fixed roller member 26 by the action of a subassembly of the double roller apparatus. The cooperative interaction of the parts of the subassembly can be seen more clearly by referring to FIG. 2 where corresponding parts are given the same numbers as in FIG. 1. The subassembly comprises a bar 62 attached to a yoke member 68 by a spring-loaded adjusting mechanism. The bar member 62 is attached to the bearing members 22 and 24 of the first roller member 20 by rods 64 and 66. A yoke member 68 is firmly attached to the mounting rails 40, 42, 44, and 46 at the end portions 70 and 72 of the yoke member 68. A compression spring 94 bears oppositely against yoke member 68 and bar 62 to urge roller member 20 toward roller 26. Movement of roller member 20 toward the second roller member 26 is restrained by the cooperative action of the connecting rods 64 and 66 attached to slideable bearing members 22 and 24, rod 62, and the threaded shafts 74 and 96 connecting bar 62 to knob 78.

A roller positioning tube 74 is threaded over a portion of the length of its outside surface and over a portion of the length of its axial bore 80. In the fully assembled double roller apparatus, the threaded positioning tube 74 passes through opening 82 in the wall 83 of yoke member 68. The unthreaded portion of the length of the outside surface of positioning tube 74 is received firmly but rotatably and slideably inside opening 82. Knob 78 is fixedly attached to positioning tube 74 at one end to permit facile rotation of tube 74 by hand.

A compression spring 94 fits concentrically over positioning tube 74 and is disposed between bearing collars 90 and 92. The interior surface of bore 98 of bearing collar 92 is threaded to receive and engage the threaded outer surface of positioning tube 74. Rotation of the internally threaded bearing collar 92 on positioning tube 74 shortens or lengthens compression spring 94. When spring 94 is under tension, bearing collar 90 bears firmly but rotatably against surface 84 of the yoke member wall 83 and the inner surface 86 of knob 78 bears oppositely but rotatably against bearing washer 102 which in turn bears against surface 88 of the yoke member wall 83. Thus the positioning tube 74, knob 78, the compression spring 94, the two bearing collars 90 and 92, and bearing washer 102 are held firmly together in yoke 68 by the force exerted by the compression spring 94. The force is variably selectable and depends upon the force constant of the spring and the degree to which the spring has been compressed by tightening down threaded collar 92 against the spring 94.

In a preferred embodiment of the invention, bearing washer 102 and bearing collar 90 are made of a self-lubricating plastic such as polytetrafluoroethylene, nylon, polyethylene, polypropylene, or the like to permit facile rotation of these parts against the appropriate surfaces of wall 83 of the yoke member 68.

A threaded roller positioning rod 96, fixedly attached at one end to bar member 62 is threaded and is received and engaged by the threaded bore 80 of positioning tube 74. Rotation of knob 78 with its attached positioning tube 74 causes bar 62 to move toward or away from yoke member 68.

Although held in place by the force exerted by compression spring 94, the positioning tube 74 is slideably movable in opening 82 when a force is exerted against bar 62 which exceeds the force exerted by the compressed spring. Acting in response to such a force, the positioning tube 74 moves axially through opening 82, further compressing spring 94, resulting in movement of bar 62 and its attached bearing members 22 and 24 toward the yoke 68. As it is compressed, spring 94 exerts an opposite restoring force to return bar 62 to its original position. Movement of the bar 62 away from the yoke 68 is halted when the knob 78 and bearing washer 102 again bear against wall 83 of the yoke member 68.

When knob 78 and bearing washer 102 bear against wall 83 of the yoke member 68, the relative positioning of bar 62 and yoke member 68 can be variably selected independently of any adjustment of the tension of spring 94 by rotating knob 78. During such rotation, positioning tube 74, bearing collars 90 and 92, and compression spring 94 turn together, while bar 62 and its attached positioning rod 96 do not rotate. The result of rotating knob 78 in either a clockwise or counterclockwise direction is to cause bar 62 and the attached roller member 20 to move toward or away from yoke 68 without affecting the degree of tension of spring 94.

Referring again to FIG. 1, the cooperative interaction of the parts of the complete assembled apparatus in accordance with this embodiment of the invention can be seen more clearly.

Bearing members 28 and 30 are fixedly clamped to mounting rails 40, 42, 44, and 46. Similarly, end portions 70 and 72 of yoke member 68 are fixedly clamped to the mounting rails. The initial minimum gap spacing between the first movable roller member 20 and the second fixed roller member 26 is adjusted by turning knob 78 which causes bearing members 22 and 24 to move slideably along the mounting rails. The desired minimum roller gap spacing is determined by placing a gage between the rollers.

The minimum restoring force exerted by spring 94 is adjusted to the desired value by holding knob 78 to prevent its rotation while turning bearing collar 92 to compress spring 94. Within the range of its elastic limits, spring 94 will exert a restoring force directly proportional to the degree of its compression in accordance with the well known Hooke's Law relationship. For double roller chill casting of various alloy compositions, springs of various compressional spring constants are employed and are interchangeable in the apparatus. The particular spring to be employed may be readily determined by experimentation. Springs capable of exerting up to about 500 pounds of force are employed with forces in the range of about 100–200 lb. preferred.

To chill cast metal foil employing the apparatus of this embodiment of the invention, the molten metal is delivered as a pressurized stream between the rapidly rotating chill roller members 20 and 26. As material solidifies between the roller members and tends to exert a force to displace the movable roller member from its position of minimum gap spacing, compression of spring 94 causes a restoring force to be exerted urging roller member 20 toward roller member 26. The magnitude of the restoring force increases as the roller gap increases until a dynamic steady state balancing is achieved between the displacing and restoring forces. The apparatus thus automatically and dynamically adjusts the roller gap to a value slightly larger than the present minimum gap spacing. The foil which is produced is free of the cracks and slippage plane deformations which characterize foil produce by double roller techniques employing two fixed rollers. Moreover, the dynamic self-adjustment of the rollers during the casting of foil eliminates the bumping and bouncing of the rollers which tends to cause non-uniformity of foil thickness.

In order to determine the best conditions for casting foil with the apparatus in accordance with the preferred embodiment of the present invention, several samples were prepared from tin and from an alloy comprising 88 w/o aluminum and 12 w/o silicon. The internally water-cooled rollers were 15 cm in diameter and approximately 15 cm wide and were faced with copper. The rollers were driven by a variable speed DC motor at various rotational rates up to about 2700 rpm depending upon the particular example, as detailed further below.

The melt delivery assembly consisted of a quartz pressure vessel located inside a resistance heating coil. The pressure vessel was mounted on a movable stage so that the crucible could be positioned relative to the rollers either before or during a casting run. A metal charge of several hundred grams was melted in each casting run by heating the metal to a temperature about 50° C. to 100° C. above its melting point under an argon gas blanket to prevent oxidation of the melt. To initiate flow of the molten metal through the orifice in the bottom of the crucible, the argon pressure over the melt was increased to about 2–10 psig over ambient pressure. Crucibles with circular orifice diameters of up to about 3 mm were employed. When larger orifice diameters were employed it was necessary to restrain the flow of molten metal from the heated crucible prior to beginning a casting run.

Figure 3:
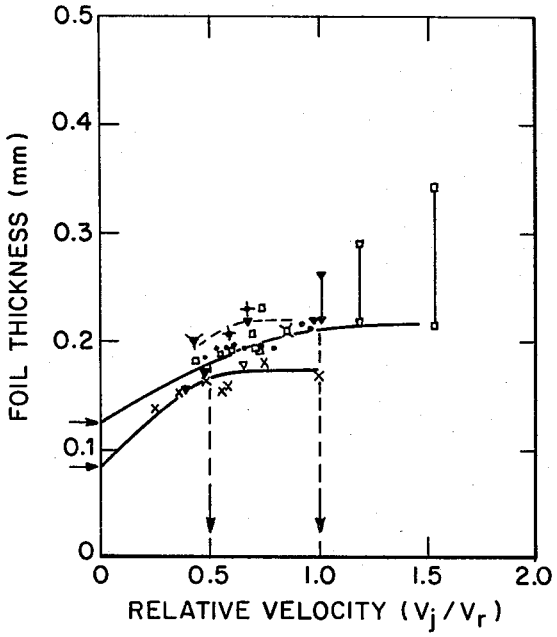
FIG. 3 is a graphic representation of the relationship between the ratio of molten metal jet velocity to roller velocity and the thickness of foil produced by the apparatus in accordance with the embodiment of FIG. 1.

At overpressures of from about 2 to 10 psig, a stable jet of molten metal forms and is forced through the orifice with a jet velocity $V_j$ which is nominally independent of the liquid head height pressure. Foil thickness and width varied with the velocity of the jet, the roller rotational velocity $V_r$, the preset roller gap spacing $g_o$, and the magnitude of the movable roller restraining force $F_o$. Data for several examples of foil cast from molten tin appear in Table 1. The foil thickness of each example of Table 1 has been plotted versus the ratio of jet velocity to roller velocity, $V_j/V_r$ in FIG. 3.

TABLE 1

| EXAMPLE | | INITIAL ROLLER GAP SPACING ($g_o$) mm | inches | INITIAL ROLLER RESTRAINING FORCE ($F_o$) lb | ARGON GAS OVERPRESSURE psig |
|---|---|---|---|---|---|
| I | □ | 0.127 | 0.050 | 200 | 10 |
| II | ⌑ | 0.127 | 0.050 | 100 | 10 |
| III | ● | 0.127 | 0.050 | 200 | 5 |
| IV | ⊕ | 0.127 | 0.050 | 100 | 5 |
| V | ▼ | 0.127 | 0.050 | 200 | 3 |
| VI | Y | 0.127 | 0.050 | 100 | 3 |
| VII | X | 0.080 | 0.032 | 200 | 10 |

Continuous foils were cast when the ratio of jet velocity to roller velocity was between about 0.5 and 1.0. As can be seen by examination of FIG. 3, in this range of $V_j/V_r$, the foil thickness is relatively insensitive to the velocity ratio. In those cases where the jet velocity is greater than the roller velocity, the accumulation of liquid metal between the rollers above the point of minimum spacing (i.e. "puddling") complicates the lateral flow pattern of the solidifying liquid metal. Consequently, these foils exhibit gross variation in thickness as shown by the vertical bars in the data plotted in FIG. 3. For conditions where the jet velocity is substantially less than the roller velocity (i.e., where $V_j/V_r<0.5$), the supply of liquid to the roller gap is insufficient resulting in periodic discontinuities in the foil. Therefore, in order to produce continuous foil with the apparatus of the present invention, a ratio of liquid metal jet velocity to roller velocity between about 0.5 and 1.0 is preferred.

While the thickness of the chill quenched foil was found to be relatively insensitive to the ratio of jet and roller velocities in the preferred range of 0.5 to 1.0, it was found that within this range of velocity ratios, an essentially linear relationship exists between initial roller gap spacing, $g_o$, and foil thickness when the preset roller gap spacing is below about one-third the jet diameter. The jet diameter in turn is determined by the crucible orifice diameter. The data for several foil samples is presented in Table 2; as can be seen by examination of those data, the foil thickness is greater than that of the initial roller gap setting, indicating the complete solidification of the metal prior to entering the region of minimum spacing between the rollers. To obtain films which were of essentially uniform thickness and of uniform physical composition across the film from one face to the other, ratios of initial roller gap setting to orifice diameter of less than about 0.33 are preferred.

TABLE 2

| EX. | MATERIAL | ROLLER SURFACE VELOCITY (cm/s) | INITIAL ROLLER GAP (cm) | CRUCIBLE ORIFICE DIAMETER (cm) | ARGON OVER-PRESSURE (psig) | MASS FLOW RATE (gm/s) | FOIL THICKNESS (cm) | FOIL WIDTH (cm) |
|---|---|---|---|---|---|---|---|---|
| VIII | Sn | 480 | 0.013 | 0.1 | 10 | 25.0 | 0.02 ± 0.0002 | 0.40 |
| IX | Sn | 560 | 0.0076 | 0.2 | 5 | 73.0 | 0.02 ± 0.0015 | 1.04 |
| X | Sn | 560 | 0.0076 | 0.2 | 10 | 100.0 | 0.021 ± 0.0014 | 1.75 |
| XI | Al—Si | 480 | 0.0076 | 0.15 | 10 | 34.0 | 0.023 ± 0.007 | 1.16 |

Figure 4:
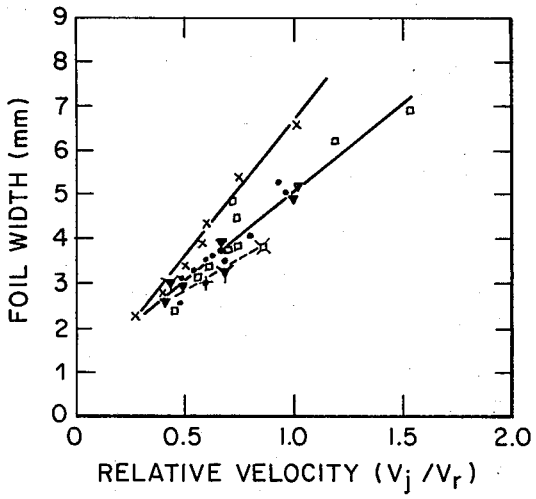
FIG. 4 is a graphic representation of the relationship between the ratio of molten metal jet velocity to roller velocity and the width of foil produced by the apparatus in accordance with the embodiment of FIG. 1.

The jet mass flow rate becomes important in establishing the final width of the foil, especially when smaller initial roller gap spacings are employed. Under these conditions, the liquid metal must spread laterally across the roller faces over relatively large distances perpendicular to the axis of foil movement through the rollers. As this occurs, heat loss from the liquid metal causes increases in viscosity resulting in nonuniform spreading of the liquid on the roller faces. The foil which results generally has a rough edge. When the foil width is approximately 5 times the initial jet diameter or less, foil with nominally linear foil edges were produced. The variation of foil width with variation in the ratio of jet to roller velocity for the examples of Table 1 has been plotted in FIG. 4. Because of cooling of the liquid metal as it spreads across the roller faces during casting, it is apparent that foils of unlimited width cannot be produced by merely making the orifice diameter larger. However, careful adjustment of the mass flow rate, especially the jet to roller velocity ratio, and the gap setting makes possible the production of dimensionally stable continuous foil employing the apparatus in accordance with this invention.

While there have been shown what is as present believed to be the preferred embodiments of the invention, it will be obvious to those skilled in the art that various changes and modifications may be made therein without departing from the scope of the invention as defined by the appended claims.

What is claimed is:

1. An apparatus for double roller chill casting of continuous metal foil comprising:

a plurality of substantially parallel mounting members;

first and second bearing members slideably mounted on said mounting members;

first rotary chill roller member rotatably mounted on said first and second bearing members;

third and fourth bearing members fixedly mounted on said mounting members;

second rotary chill roller member rotatably mounted on said third and fourth bearing members;

a yoke member fixedly mounted at each end thereof to said mounting members;

a bar member disposed laterally adjacent to and spaced apart from said first roller member, said bar member attached at the ends thereof to said first and said second bearing members;

positioning and restoring means disposed between said bar member and said yoke member for urging said bar member away from said yoke member and toward said second roller member and for maintaining said first roller spaced apart from said second roller member by a selectably variable minimum spacing;

means for synchronously contrarotating said first and said second roller members; and means for delivering molten metal between said first and said second roller members;

whereby when molten metal is delivered between the contrarotating roller members and material between said roller members exerts a displacing force to move said first roller member away from its position of minimum spacing from said second roller member, said restoring means exerts a force on said bar member to slideably urge said first and said second bearing members and said first roller member toward said second roller member to establish a dynamic steady state spacing between said first and said second roller members to produce continuous metal foil of substantially uniform thickness equal to said dynamic steady state spacing.

2. An apparatus for double roller chill casting of continuous metal foil in accordance with claim 1 wherein said positioning and restoring means comprises a positioning tube member threaded for a portion of the outside surface thereof and for a portion of the axial bore thereof, said positioning tube slideably mounted on said yoke member, a bearing collar internally threaded to engage the threaded outer surface of said positioning tube, a compression spring disposed concentrically on said positioning tube between said threaded bearing collar and said yoke member, and threaded position rod member fixedly attached at one end thereof to said bar member and received at the other end thereof in said axial bore of said positioning tube member, whereby rotation of said threaded bearing collar on said positioning tube member changes the length of said compression spring permitting variable selectable adjustment of the restoring force urging said first roller member toward said second roller member, and whereby rotation of said positioning tube member with respect to said position rod member changes the distance between said yoke member and said rod member permitting variable selectable adjustment of said minimum spacing between said first and said second roller members.

3. An apparatus for double roller chill casting of continuous metal foil in accordance with claim 2 wherein said means for delivering molten metal between said first and said second roller members comprises a heated crucible having a circular orifice in the base thereof and means for applying gaseous pressure to the molten metal contained therein to force said molten metal through said orifice with a velocity $V_j$.

4. An apparatus for double roller chill casting of continuous metal foil in accordance with claim 3 wherein said first and said second roller members are synchronously contrarotated at a velocity $V_r$ whereby the ratio of said molten metal jet velocity to said roller velocity, $V_j/V_r$, is between about 0.5 and about 1.0.

5. An apparatus for double roller chill casting of continuous metal foil in accordance with claim 4 wherein said minimum spacing between said first and said second roller members is less than about one-third the diameter of said circular orifice in the base of said crucible.

6. An apparatus for double roller chill casting of continuous metal foil in accordance with claim 1 wherein said first and said second roller members include means for circulating a coolant fluid internally to said roller members during the casting of continuous metal foil.

* * * * *